US008300032B2

(12) United States Patent
Chen et al.

(10) Patent No.: US 8,300,032 B2
(45) Date of Patent: Oct. 30, 2012

(54) METHOD FOR TRANSMITTING IMAGE DATA TO DRIVER OF DISPLAY

(75) Inventors: Pen-Hsin Chen, Tainan County (TW); Ling-Shiou Huang, Tainan County (TW)

(73) Assignee: Himax Technologies Limited, Shinshih Township (TW)

( * ) Notice: Subject to any disclaimer, the term of this patent is extended or adjusted under 35 U.S.C. 154(b) by 712 days.

(21) Appl. No.: 11/850,261

(22) Filed: Sep. 5, 2007

(65) Prior Publication Data

US 2009/0058835 A1 Mar. 5, 2009

(51) Int. Cl.
*G09G 5/00* (2006.01)

(52) U.S. Cl. ..... 345/204; 345/98; 345/211

(58) Field of Classification Search ..... 345/211, 345/204, 60, 76, 82, 87, 98, 93, 208; 710/33, 710/71

See application file for complete search history.

(56) References Cited

U.S. PATENT DOCUMENTS

| | | | | |
|---|---|---|---|---|
| 5,838,327 | A * | 11/1998 | Seong | 345/419 |
| 7,091,937 | B2 * | 8/2006 | Nakamura | 345/76 |
| 7,259,739 | B2 * | 8/2007 | Yun et al. | 345/93 |
| 2001/0017618 | A1 * | 8/2001 | Azami | 345/204 |
| 2003/0085885 | A1 * | 5/2003 | Nakayoshi et al. | 345/205 |
| 2006/0002483 | A1 * | 1/2006 | Kim | 375/257 |
| 2007/0028012 | A1 * | 2/2007 | Nonoyama et al. | 710/33 |
| 2007/0229434 | A1 * | 10/2007 | Liao | 345/98 |

* cited by examiner

*Primary Examiner* — Stephen Sherman

(57) ABSTRACT

A method for transmitting image data to a driver of a display is provided, in which the image data include pixel values each represented by a number of bits. The method includes the steps of sequentially transmitting at least two bits of one of the pixel values during a first period through a data line; and sequentially transmitting at least two bits of another one of the pixel values during a second period next to the first period through the data line, in which an order of the last bit transmitted during the first period is the same as that of the first bit transmitted during the second period.

10 Claims, 6 Drawing Sheets

| | | | | | | | | | | | | | | | | |
|---|---|---|---|---|---|---|---|---|---|---|---|---|---|---|---|---|
| R1(0) | R2(0) | R3(0) | R4(0) | R5(0) | R6(0) | R7(0) | R8(0) | R1(1) | R2(1) | R3(1) | R4(1) | R5(1) | R6(1) | R7(1) | R8(1) | ····· |
| R1(2) | R2(2) | R3(2) | R4(2) | R5(2) | R6(2) | R7(2) | R8(2) | R1(3) | R2(3) | R3(3) | R4(3) | R5(3) | R6(3) | R7(3) | R8(3) | ····· |
| R1(4) | R2(4) | R3(4) | R4(4) | R5(4) | R6(4) | R7(4) | R8(4) | R1(5) | R2(5) | R3(5) | R4(5) | R5(5) | R6(5) | R7(5) | R8(5) | ····· |
| G1(0) | G2(0) | G3(0) | G4(0) | G5(0) | G6(0) | G7(0) | G8(0) | G1(0) | G2(0) | G3(0) | G4(0) | G5(0) | G6(0) | G7(0) | G8(0) | ····· |
| G1(2) | G2(2) | G3(2) | G4(2) | G5(2) | G6(2) | G7(2) | G8(2) | G1(3) | G2(3) | G3(3) | G4(3) | G5(3) | G6(3) | G7(3) | G8(3) | ····· |
| G1(4) | G2(4) | G3(4) | G4(4) | G5(4) | G6(4) | G7(4) | G8(4) | G1(5) | G2(5) | G3(5) | G4(5) | G5(5) | G6(5) | G7(5) | G8(5) | ····· |
| B1(0) | B2(0) | B3(0) | B4(0) | B5(0) | B6(0) | B7(0) | B8(0) | B1(1) | B2(1) | B3(1) | B4(1) | B5(1) | B6(1) | B7(1) | B8(1) | ····· |
| B1(2) | B2(2) | B3(2) | B4(2) | B5(2) | B6(2) | B7(2) | B8(2) | B1(3) | B2(3) | B3(3) | B4(3) | B5(3) | B6(3) | B7(3) | B8(3) | ····· |
| B1(4) | B2(4) | B3(4) | B4(4) | B5(4) | B6(4) | B7(4) | B8(4) | B1(5) | B2(5) | B3(5) | B4(5) | B5(5) | B6(5) | B7(5) | B8(5) | ····· |

| | | | | | | | | | | | | | | | | |
|---|---|---|---|---|---|---|---|---|---|---|---|---|---|---|---|---|
| R1(0) | R2(0) | R3(0) | R4(0) | R5(0) | R6(0) | R7(0) | R8(0) | R1(1) | R2(1) | R3(1) | R4(1) | R5(1) | R6(1) | R7(1) | R8(1) | ····· |
| R1(2) | R2(2) | R3(2) | R4(2) | R5(2) | R6(2) | R7(2) | R8(2) | R1(3) | R2(3) | R3(3) | R4(3) | R5(3) | R6(3) | R7(3) | R8(3) | ····· |
| R1(4) | R2(4) | R3(4) | R4(4) | R5(4) | R6(4) | R7(4) | R8(4) | R1(5) | R2(5) | R3(5) | R4(5) | R5(5) | R6(5) | R7(5) | R8(5) | ····· |
| G1(0) | G2(0) | G3(0) | G4(0) | G5(0) | G6(0) | G7(0) | G8(0) | G1(0) | G2(0) | G3(0) | G4(0) | G5(0) | G6(0) | G7(0) | G8(0) | ····· |
| G1(2) | G2(2) | G3(2) | G4(2) | G5(2) | G6(2) | G7(2) | G8(2) | G1(3) | G2(3) | G3(3) | G4(3) | G5(3) | G6(3) | G7(3) | G8(3) | ····· |
| G1(4) | G2(4) | G3(4) | G4(4) | G5(4) | G6(4) | G7(4) | G8(4) | G1(5) | G2(5) | G3(5) | G4(5) | G5(5) | G6(5) | G7(5) | G8(5) | ····· |
| B1(0) | B2(0) | B3(0) | B4(0) | B5(0) | B6(0) | B7(0) | B8(0) | B1(1) | B2(1) | B3(1) | B4(1) | B5(1) | B6(1) | B7(1) | B8(1) | ····· |
| B1(2) | B2(2) | B3(2) | B4(2) | B5(2) | B6(2) | B7(2) | B8(2) | B1(3) | B2(3) | B3(3) | B4(3) | B5(3) | B6(3) | B7(3) | B8(3) | ····· |
| B1(4) | B2(4) | B3(4) | B4(4) | B5(4) | B6(4) | B7(4) | B8(4) | B1(5) | B2(5) | B3(5) | B4(5) | B5(5) | B6(5) | B7(5) | B8(5) | ····· |

| | | | | | | | | | | | | | | | | |
|---|---|---|---|---|---|---|---|---|---|---|---|---|---|---|---|---|
| R1(0) | R2(0) | R3(0) | R4(0) | R5(0) | R6(0) | R7(0) | R8(0) | R1(3) | R2(3) | R3(3) | R4(3) | R5(3) | R6(3) | R7(3) | R8(3) | ····· |
| R1(1) | R2(1) | R3(1) | R4(1) | R5(1) | R6(1) | R7(1) | R8(1) | R1(4) | R2(4) | R3(4) | R4(4) | R5(4) | R6(4) | R7(4) | R8(4) | ····· |
| R1(2) | R2(2) | R3(2) | R4(2) | R5(2) | R6(2) | R7(2) | R8(2) | R1(5) | R2(5) | R3(5) | R4(5) | R5(5) | R6(5) | R7(5) | R8(5) | ····· |
| G1(0) | G2(0) | G3(0) | G4(0) | G5(0) | G6(0) | G7(0) | G8(0) | G1(0) | G2(0) | G3(0) | G4(0) | G5(0) | G6(0) | G7(0) | G8(0) | ····· |
| G1(1) | G2(1) | G3(1) | G4(1) | G5(1) | G6(1) | G7(1) | G8(1) | G1(4) | G2(4) | G3(4) | G4(4) | G5(4) | G6(4) | G7(4) | G8(4) | ····· |
| G1(2) | G2(2) | G3(2) | G4(2) | G5(2) | G6(2) | G7(2) | G8(2) | G1(5) | G2(5) | G3(5) | G4(5) | G5(5) | G6(5) | G7(5) | G8(5) | ····· |
| B1(0) | B2(0) | B3(0) | B4(0) | B5(0) | B6(0) | B7(0) | B8(0) | B1(3) | B2(3) | B3(3) | B4(3) | B5(3) | B6(3) | B7(3) | B8(3) | ····· |
| B1(1) | B2(1) | B3(1) | B4(1) | B5(1) | B6(1) | B7(1) | B8(1) | B1(4) | B2(4) | B3(4) | B4(4) | B5(4) | B6(4) | B7(4) | B8(4) | ····· |
| B1(2) | B2(2) | B3(2) | B4(2) | B5(2) | B6(2) | B7(2) | B8(2) | B1(5) | B2(5) | B3(5) | B4(5) | B5(5) | B6(5) | B7(5) | B8(5) | ····· |

METHOD FOR TRANSMITTING IMAGE DATA TO DRIVER OF DISPLAY

BACKGROUND

1. Field of Invention

The present invention relates to a method for transmitting image data. More particularly, the present invention relates to a method for transmitting image data to a driver of a liquid crystal display.

2. Description of Related Art

In a display system, pixel values of image data are typically transmitted one by one through a number of data lines. More specifically, when bits of one of the pixel values are transmitted, the bits changing in a time series manner are transmitted in parallel from a transmitter to a receiver.

FIG. 1 shows the pixel value waveforms transmitted in a conventional display system. As shown, the first and second ordered bits of the first pixel value, i.e. R[0] and R[1], are sequentially transmitted through one of the data lines, and the third and fourth ordered bits of the first pixel value, i.e. R[2] and R[3], are sequentially transmitted through another one of the data lines, and the fifth and sixth ordered bits of the first pixel value, i.e. R[4] and R[5], are sequentially transmitted through yet another one of the data lines. Other pixel values are similarly transmitted.

In order to reduce the transmission lines and speed up the transmission, a high-speed serial bus, serving as a set of the data lines, usually transmits the image data. However, when the transmission becomes faster, the electromagnetic interference (EMI) radiation and the power consumption become higher because of the toggle rate, i.e. the number of bit changes.

For the foregoing reasons, there is a need to reduce the toggle rate when transmitting the image data, so as to reduce the electromagnetic interference radiation and the power consumption.

SUMMARY

In accordance with one embodiment of the present invention, a method for transmitting image data to a driver of a display is provided, in which the image data include a plurality of pixel values each represented by a plurality of bits. The method includes the steps of sequentially transmitting at least two bits of one of the pixel values during a first period through a data line; and sequentially transmitting at least two bits of another one of the pixel values during a second period next to the first period through the data line, in which an order of the last bit transmitted during the first period is the same as that of the first bit transmitted during the second period.

In accordance with another embodiment of the present invention, another method for transmitting image data to a driver of a display is provided, in which the image data include a plurality of pixel values each represented by at least a first and a second ordered bit. The method includes the steps of sequentially transmitting the first bits of the pixel values during a first period through a data line, in which orders of the first bits transmitted during the first period are the same; and sequentially transmitting the second bits of the pixel values during a second period through the data line.

For the foregoing embodiments of the present invention, the method for transmitting image data to a driver of a display is capable of reducing the toggle rate of the data transmission, so as to reduce the electromagnetic interference (EMI) radiation and the power consumption.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiments, with reference made to the accompanying drawings as follows.

DESCRIPTION OF THE PREFERRED EMBODIMENTS

In accordance with one embodiment of the present invention, a method for transmitting image data to a driver of a display is provided, in which the image data include a number of pixel values each represented by a number of bits, and each pixel value is a red, green or blue pixel value. The method includes the steps of sequentially transmitting at least two bits of one of the pixel values during a first period through a data line; and sequentially transmitting at least two bits of another one of the pixel values during a second period after the first period through the data line, in which the order of the last bit transmitted during the first period is the same as that of the first bit transmitted during the second period.

Figure 1:
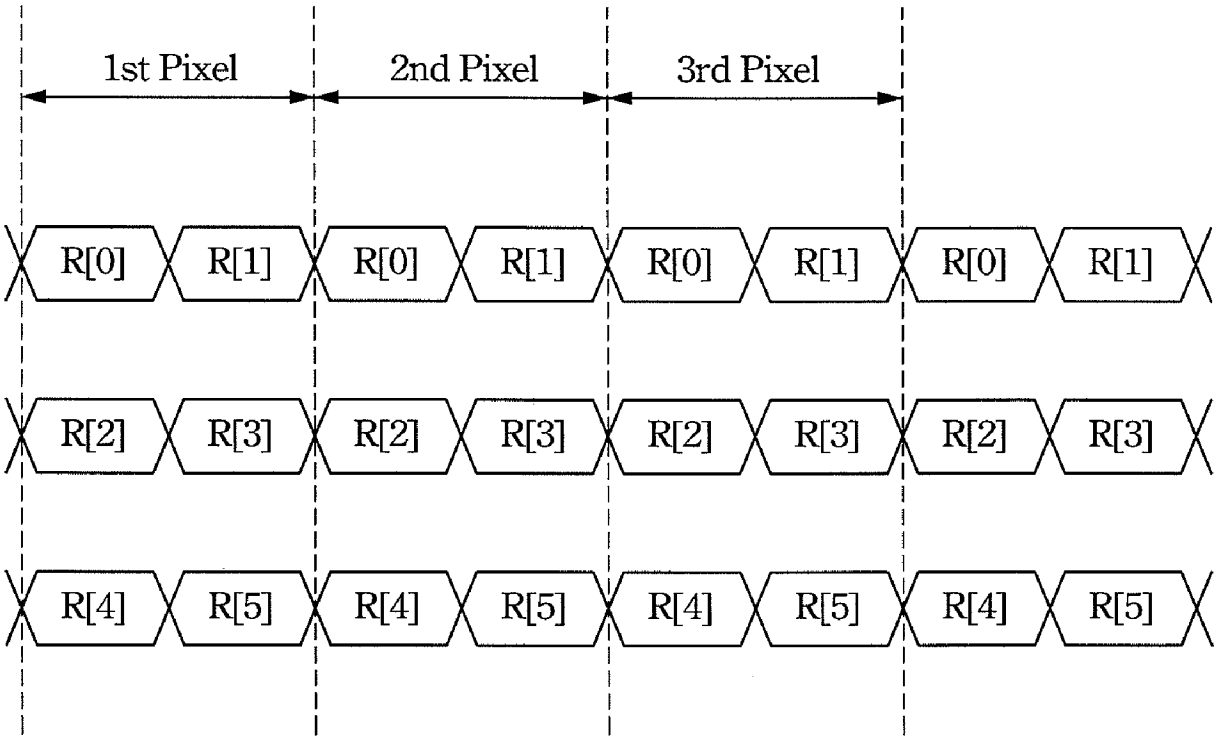
Fig. 1 (PRIOR ART)
FIG. 1 shows the pixel value waveforms transmitted in a conventional display system.
Figure 2:
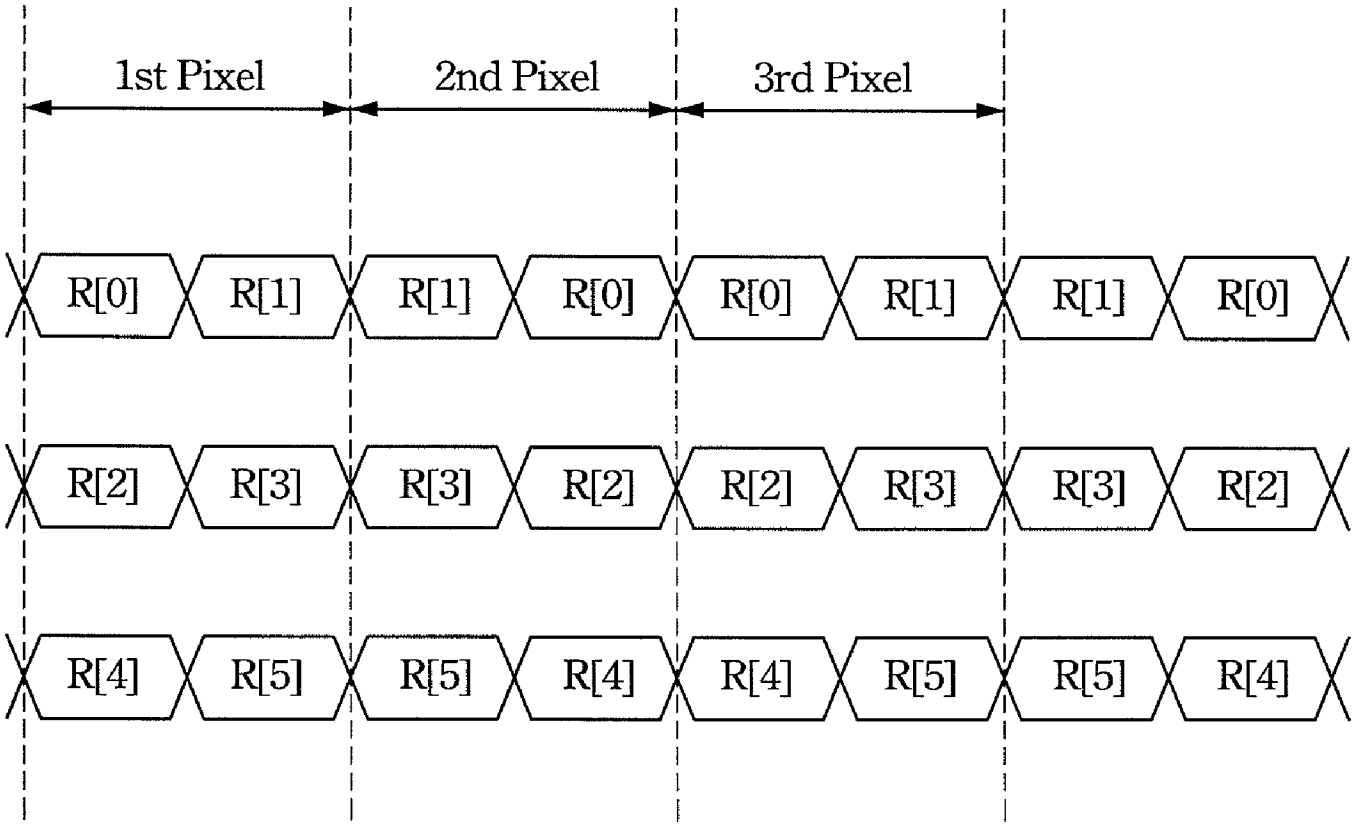
FIG. 2 shows the pixel value waveforms when using the method for transmitting the image data according to a first embodiment of the present invention.

FIG. 2 shows the pixel value waveforms when using the method for transmitting the image data according to a first embodiment of the present invention. As shown, when each pixel value is represented by six bits, i.e. R[0], R[1], . . . , R[5], the six bits of each pixel value are transmitted through three of the data lines. During the first period, the six bits of the first pixel value are sequentially transmitted through three of the data lines, respectively; that is, R[0] and R[1] are sequentially transmitted through one of the data lines, R[2] and R[3] are sequentially transmitted through another one of the data lines, and R[4] and R[5] are sequentially transmitted through yet another one of the data lines.

During the second period after the first period, the six bits of the second pixel value are sequentially transmitted through the data lines as well, in which the order of the last bit transmitted during the first period is the same as that of the first bit transmitted during the second period; that is, R[1] and R[0] are sequentially transmitted through one of the data lines, R[3] and R[2] are sequentially transmitted through another one of the data lines, and R[5] and R[4] are sequentially transmitted through yet another one of the data lines.

During the third period after the second period, the six bits of the third pixel value are sequentially transmitted through the data lines as well, in which the order of the last bit transmitted during the second period is the same as that of the first bit transmitted during the third period; that is, R[0] and R[1] are sequentially transmitted through one of the data lines, R[2] and R[3] are sequentially transmitted through another one of the data lines, and R[4] and R[5] are sequentially transmitted through yet another one of the data lines. The rest of the pixel values are transmitted similarly.

Figure 3:
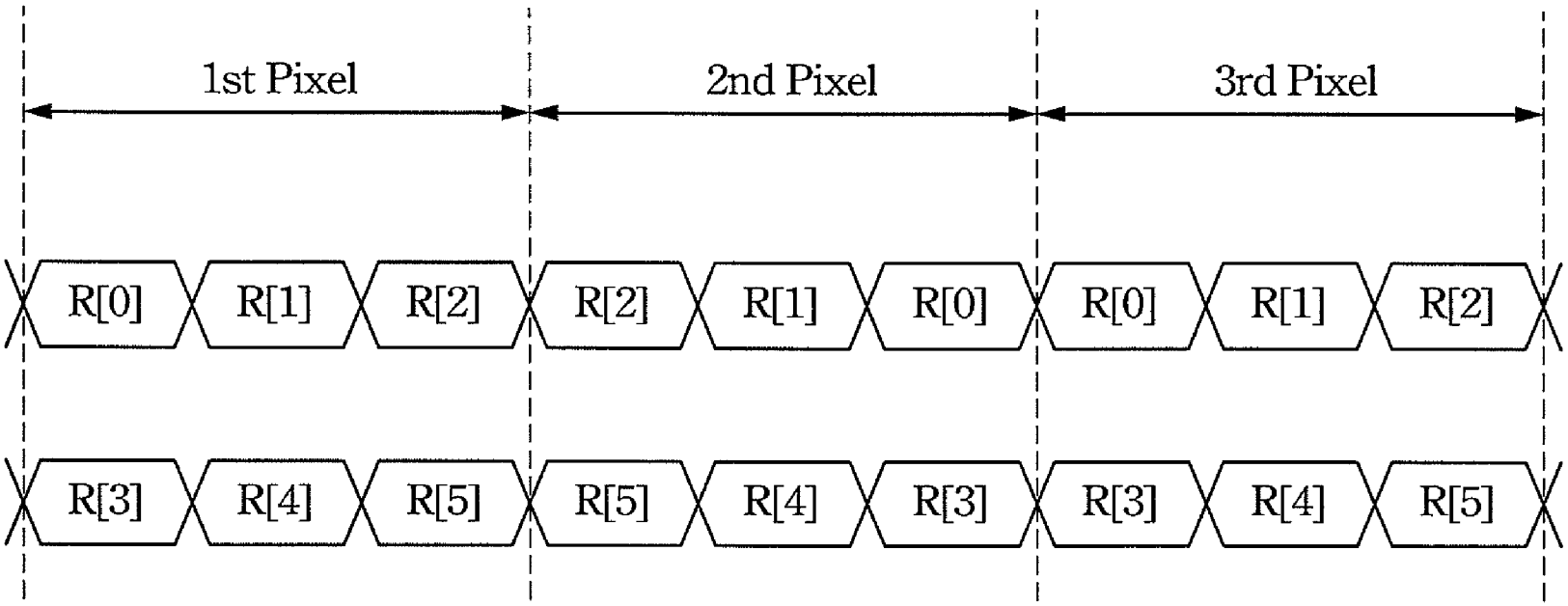
FIG. 3 shows the pixel value waveforms when using the method for transmitting the image data according to a second embodiment of the present invention.

FIG. 3 shows the pixel value waveforms when using the method for transmitting the image data according to a second embodiment of the present invention. The six bits of each pixel value are transmitted through two of the data lines. During the first period, the six bits of the first pixel value are sequentially transmitted through two of the data lines, respectively; that is, R[0], R[1] and R[2] are sequentially transmitted through one of the data lines, and R[3], R[4] and R[5] are sequentially transmitted through the other one of the data lines.

During the second period after the first period, the six bits of the second pixel value are sequentially transmitted through the data lines as well, in which the order of the last bit transmitted during the first period is the same as that of the first bit transmitted during the second period; that is, R[2], R[1] and R[0] are sequentially transmitted through one of the data lines, and R[5], R[4] and R[3] are sequentially transmitted through the other one of the data lines.

During the third period after the second period, the six bits of the third pixel value are sequentially transmitted through the data lines as well, in which the order of the last bit transmitted during the second period is the same as that of the first bit transmitted during the third period; that is, R[0], R[1] and R[2] are sequentially transmitted through one of the data lines, and R[3], R[4] and R[5] are sequentially transmitted through the other one of the data lines. The rest of the pixel values are transmitted similarly.

Figure 4:
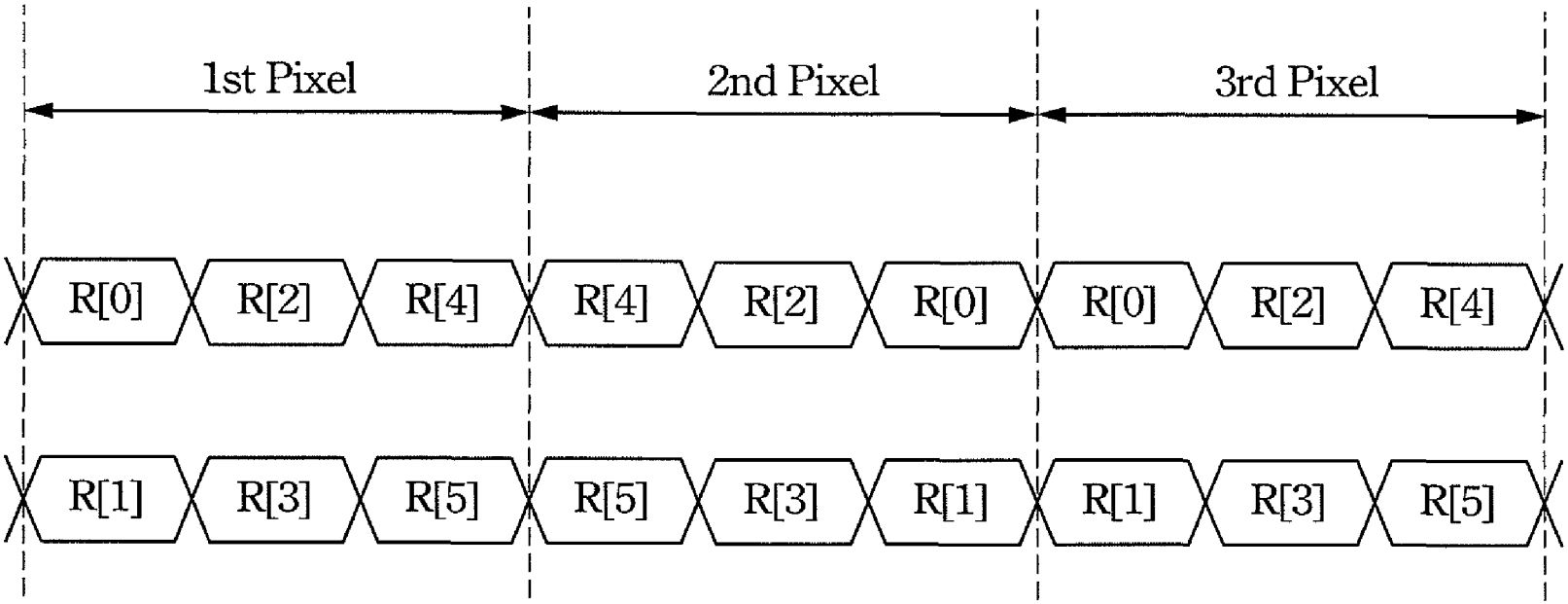
FIG. 4 shows the pixel value waveforms when using the method for transmitting the image data according to a third embodiment of the present invention.

FIG. 4 shows the pixel value waveforms when using the method for transmitting the image data according to a third embodiment of the present invention. Compared to FIG. 3, the six bits of the first pixel value are transmitted through two of the data lines, respectively, and transmitted alternately by one bit through the data lines during the first period; that is, R[0], R[2] and R[4] are sequentially transmitted through one of the data lines, and R[1], R[3] and R[5] are sequentially transmitted through the other one of the data lines.

During the second period after the first period, the six bits of the second pixel value are sequentially transmitted through the data lines as well, in which the order of the last bit transmitted during the first period is the same as that of the first bit transmitted during the second period; that is, R[4], R[2] and R[0] are sequentially transmitted through one of the data lines, and R[5], R[3] and R[1] are sequentially transmitted through the other one of the data lines.

During the third period after the second period, the six bits of the third pixel value are sequentially transmitted through the data lines as well, in which the order of the last bit transmitted during the second period is the same as that of the first bit transmitted during the third period; that is, R[0], R[2] and R[4] are sequentially transmitted through one of the data lines, and R[1], R[3] and R[5] are sequentially transmitted through the other one of the data lines. The rest of the pixel values are transmitted similarly.

As shown in FIGS. 2, 3 and 4, the bits transmitted during the first period and the second period through one of the data lines are transmitted in reverse order, and the bits transmitted during the first period and the third period through one of the data lines are transmitted in the same order. In other words, the bits of two odd pixel values transmitted through one of the data lines are transmitted in the same order, and the bits of two even pixel values transmitted through one of the data lines are transmitted in the same order.

In accordance with another embodiment of the present invention, another method for transmitting the image data to the driver of the display is provided, in which the image data include a number of pixel values each represented by at least a first and a second ordered bit, and each of the pixel values is a red, green or blue pixel value. The method includes the steps of sequentially transmitting the first bits of the pixel values during the first period through a data line, in which the orders of the first bits transmitted during the first period are the same; and then sequentially transmitting the second bits of the pixel values during the second period through the data line, in which the orders of the second bits transmitted during the second period are the same as well and different from the orders of the first bits transmitted during the first period.

Figure 5:
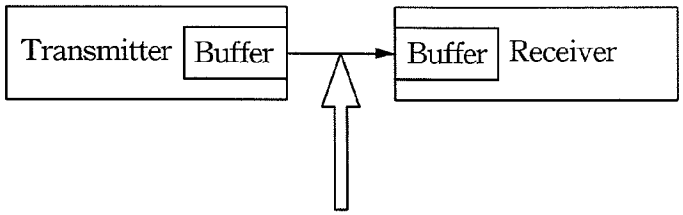
FIG. 5 shows the transmission of the pixel values according to a fourth embodiment of the present invention.

FIG. 5 shows the transmission of the pixel values according to a fourth embodiment of the present invention. As shown, the red, green and blue pixel values are transmitted from a transmitter to a receiver through the data lines, respectively, and the red, green and blue pixel values are transmitted similarly. Each of the red pixel values (same as the green and blue pixel values) is represented by the six bits, i.e. R[0], R[1], . . . , R[5]. During the first period, the first bits of the red pixel values R1, R2, . . . , and R8 are temporally stored in a buffer of the transmitter, and then sequentially transmitted to another buffer of the receiver through a data line, in which the orders of the first bits are the same; that is, R1[0], R2[0], . . . , and R8[0] are temporally stored in the buffer of the transmitter, and then sequentially transmitted to the buffer of the receiver.

During the second period after the first period, the second bits of the red pixel values R1, R2, . . . , and R8 are temporally stored in the buffer of the transmitter, and then sequentially transmitted to the buffer of the receiver through the data line, in which the orders of the second bits are the same and successive to the orders of the first bits transmitted during the first period; that is, R1[1], R2[1], . . . , and R8[1] are temporally stored in the buffer of the transmitter, and then sequentially transmitted to the buffer of the receiver during the second period.

Furthermore, during the first period, the third bits of the red pixel values R1, R2, . . . , and R8 are temporally stored in the buffer of the transmitter, and then sequentially transmitted to the buffer of the receiver through another data line, in which the orders of the third bits are the same and successive to the orders of the second bits; that is, R1[2], R2[2], . . . , and R8[2] are temporally stored in the buffer of the transmitter, and then sequentially transmitted to the buffer of the receiver through another data line. The fourth bits, whose orders are successive to the orders of the third bits, i.e. R1[3], R2[3], . . . , and R8[3], are temporally stored in the buffer of the transmitter, and then sequentially transmitted to the buffer of the receiver through the same data line during the second period.

Moreover, during the first period, the fifth bits of the red pixel values R1, R2, . . . , and R8 are temporally stored in the buffer of the transmitter, and then sequentially transmitted to the buffer of the receiver through yet another data line, in which the orders of the fifth bits are the same and successive to the orders of the fourth bits; that is, R1[4], R2[4], . . . , and R8[4] are temporally stored in the buffer of the transmitter, and then sequentially transmitted to the buffer of the receiver through yet another data line. The sixth bits, whose orders are successive to the orders of the fifth bits, i.e. R1[5], R2[5], . . . , and R8[5], are temporally stored in the buffer of the transmitter, and then sequentially transmitted to the buffer of the receiver through the same data line during the second period. The green and blue pixel values are transmitted similarly.

Figure 6:
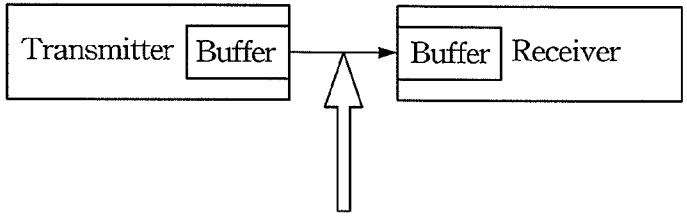
FIG. 6 shows the transmission of the pixel values according to a fifth embodiment of the present invention.

FIG. 6 shows the transmission of the pixel values according to a fifth embodiment of the present invention. Compared to FIG. 5, after the first bits are transmitted, the second bits which are different from the first bits, i.e. R1[3], R2[3], . . . , and R8[3], are temporally stored in the buffer of the transmitter, and then sequentially transmitted to the buffer of the receiver during the second period. The third bits, whose orders are successive to the orders of the first bits transmitted during the first period, i.e. R1[1], R2[1], . . . , and R8[1], are temporally stored in the buffer of the transmitter, and then sequentially transmitted to the buffer of the receiver through another data line during the first period. The fourth bits which are different from the third bits, i.e. R1[4], R2[4], . . . , and R8[4], are then transmitted through the same data line during the second period.

In addition, the fifth bits, whose orders are successive to the orders of the third bits transmitted during the first period, i.e. R1[2], R2[2], . . . , and R8[2], are temporally stored in the buffer of the transmitter, and then sequentially transmitted to the buffer of the receiver through yet another data line during the first period. The sixth bits which are different from the fifth bits, i.e. R1[5], R2[5], . . . , and R8[5], are then transmitted through the same data line during the second period. The green and blue pixel values are transmitted similarly.

For the foregoing embodiments of the present invention, the method for transmitting the image data to a driver of a display is capable of reducing the toggle rate of the data transmission, so as to reduce the electromagnetic interference (EMI) radiation and the power consumption.

As is understood by a person skilled in the art, the foregoing embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A method for transmitting image data to a driver of a display, wherein the image data comprise a plurality of pixel values of a predetermined color, each one of the pixel values being represented by at least a first bit and a second bit, the first bit and the second bit having numbered orders being numbered successively, such that the plurality of pixel values comprises a plurality of the first bits and the second bits, the method comprising the steps of:

sequentially transmitting the first bits of the pixel values during a first period through a data line; and sequentially transmitting the second bits of the pixel values during a second period following the first period through the same data line;

wherein the numbered orders of the first bits transmitted during the first period through the same data line are the same.

2. The method as claimed in claim 1, wherein the numbered orders of the second bits transmitted during the second period are the same and are different from the numbered orders of the first bits transmitted during the first period.

3. The method as claimed in claim 2, wherein the numbered orders of the second bits transmitted during the second period are successive to the numbered orders of the first bits transmitted during the first period.

4. The method as claimed in claim 1, wherein each of the pixel values is further represented by a third bit, the first bit, the second bit, and the third bit having numbered orders being numbered successively, such that the plurality of pixel values comprises a plurality of the third bits.

5. The method as claimed in claim 4, further comprising the step of:

sequentially transmitting the third bits of the pixel values during the first period through another data line;

wherein the numbered orders of the third bits transmitted during the first period are the same and are successive to the numbered orders of the first bits.

6. The method as claimed in claim 1, wherein the first bits of the pixel values are temporally stored in a buffer of a transmitter before being transmitted to another buffer of a receiver.

7. A method of transmitting image data from a first buffer to a second buffer through a data line, the image data comprising a plurality of pixel values of a predetermined color, each one of the pixel values having at least a first bit and a second bit, the first bit and the second bit having numbered orders being numbered successively, the method comprising:

sequentially transmitting the first bits, with first numbered orders, of the pixel values, during a first period through the data line; and sequentially transmitting the second bits, with second numbered orders, of the pixel values, during a second period through the data line.

8. The method of claim 7, wherein the first numbered orders and the second numbered orders are different.

9. The method of claim 7, wherein each one of the pixel values further has a third bit, the first bit, the second bit, and the third bit having numbered orders being numbered successively, and the method further comprises sequentially transmitting the third bits, with third numbered orders, of the pixel values, during the first period through another data line coupling the first buffer and the second buffer.

10. The method of claim 9, wherein the third numbered orders and the first numbered orders are different.

* * * * *